US009227447B2

(12) United States Patent
Yoshizawa

(10) Patent No.: US 9,227,447 B2
(45) Date of Patent: Jan. 5, 2016

(54) INKJET PRINTER

(71) Applicant: OKI DATA INFOTECH CORPORATION, Chiba-shi, Chiba (JP)

(72) Inventor: Takanori Yoshizawa, Chiba (JP)

(73) Assignee: Oki Data Infotech Corporation, Chiba-shi, Chiba (JP)

( * ) Notice: Subject to any disclaimer, the term of this patent is extended or adjusted under 35 U.S.C. 154(b) by 0 days.

(21) Appl. No.: 14/647,339

(22) PCT Filed: Oct. 23, 2013

(86) PCT No.: PCT/JP2013/078651
§ 371 (c)(1),
(2) Date: May 26, 2015

(87) PCT Pub. No.: WO2014/119061
PCT Pub. Date: Aug. 7, 2014

(65) Prior Publication Data

US 2015/0321493 A1 Nov. 12, 2015

(30) Foreign Application Priority Data

Jan. 29, 2013 (JP) ..... 2013-014633

(51) Int. Cl.
*B41J 29/38* (2006.01)
*B41J 29/377* (2006.01)
*B41J 2/01* (2006.01)

(52) U.S. Cl.
CPC . *B41J 29/377* (2013.01); *B41J 2/01* (2013.01)

(58) Field of Classification Search
USPC ..... 347/4–6, 9, 12–14, 16, 17, 19, 20–23, 347/25, 30, 40–44, 47, 58, 84–86, 96–68, 347/104, 102, 197, 198; 400/655
See application file for complete search history.

(56) References Cited

U.S. PATENT DOCUMENTS 6,312,092 B1 * 11/2001 Usui ..... B41J 2/16547 347/30
8,152,266 B2 * 4/2012 Sekiya ..... B41J 2/16508 347/30
2003/0011668 A1 * 1/2003 Yoshida ..... B41J 2/175 347/86
2003/0160846 A1 * 8/2003 Yoshida ..... B41J 2/17509 347/85

FOREIGN PATENT DOCUMENTS

JP 2006264328 10/2006

OTHER PUBLICATIONS

International Search Report mailed Jan. 21, 2014 issued in International Appln. No. PCT/JP2013/078651.

* cited by examiner

*Primary Examiner* — Kristal Feggins
(74) *Attorney, Agent, or Firm* — Muncy, Geissler, Olds & Lowe, P.C.

(57) ABSTRACT

In a case where suction means for taking in outside air into an inkjet printer is provided, a heated recording medium is abruptly cooled by a flow of air, thereby causing cooling unevenness, which is a factor of degradation of image quality. Further, it is difficult to efficiently cool an inside of a carriage. In view of the above, provided are a structure for allowing the outside air, which is taken into a device of the inkjet printer, to be directly sucked into the carriage, and a structure for preventing the outside air from passing through the carriage. Thus, the temperature inside the carriage can be effectively decreased. Further, mechanisms for exhausting the gas are provided on both sides of a housing, specifically, one mechanism is provided on a side surface of the housing and another mechanism is provided on a rear surface thereof. Thus, unevenness of exhausted gas can be suppressed at the right and left of the housing.

4 Claims, 5 Drawing Sheets

INKJET PRINTER

TECHNICAL FIELD

The present invention relates to an inkjet printer.

BACKGROUND ART

There is known an inkjet printer for recording an image or the like by ejecting ink onto a recording medium, such as recording paper and a resin film. In the inkjet printer, various types of inks are used. Examples of the inks include solvent ink using an organic solvent as a prime solvent, ultraviolet curable ink that is curable due to ultraviolet radiation, and thermosetting ink that is curable due to heat. The various types of inks are used depending on intended use.

In recent years, there has been a growing demand to quickly dry ink in order to promptly shift to a next work process, such as lamination of a film so as to protect a printed surface after printing and cutting of a printed product into a desired size after the printing. To meet such a demand, methods utilizing properties of inks, such as the ultraviolet curable ink and the thermosetting ink, are considered.

On the other hand, the solvent ink using the organic solvent as the prime solvent is excellent in fixability onto a resin film such as a PVC sheet, thereby achieving an advantage in that a recorded product that is highly resistant to wear can be obtained. It is desired to enhance a drying property of this type of ink. To enhance fixability onto the recording medium, this type of ink is ejected under a state in which the recording medium is moderately heated, and also after the recording, the recording medium is moderately heated in order to quickly dry the solvent. For example, a platen, a paper guide provided on a front side of the platen, and a paper guide provided on a rear side of the platen are each heated, and due to the heat, the recording medium is heated. A recording head is also heated, and further the recording head itself generates heat. On the other hand, when the temperature of the recording head or the ink is changed, the viscosity of the ink is changed accordingly, which adversely affects the ejection performance and the image quality. Thus, it is necessary to moderately cool the recording head and the ink.

For example, JP 2006-264328 A discloses a technology relating to air blowing and cooling in the printer. The related art discloses an inkjet printer using the thermosetting ink that promotes fixing due to heat. This device has a structure in which a heater is arranged above a carriage so as to extend along a scanning direction of the carriage. Therefore, the carriage is considerably heated, and hence is required to be cooled. A flow of air is forcibly formed so as to cool the carriage by the air.

CITATION LIST

Patent Literature

[PTL 1] JP 2006-264328 A

SUMMARY OF INVENTION

Technical Problem

The technology described in JP 2006-264328 A is a technology of a method involving applying heat to the ink and the recording medium immediately after the ink is ejected from an ink jet head in order to efficiently dry the ink. This type of method is also applicable to the solvent ink. However, in this case, the heater is arranged immediately above the ink jet head. In such a structure, the carriage including the ink jet head is heated immediately below the heater. Therefore, the temperature of the ink jet head is increased, thus leading to ejection failure. Therefore, in JP 2006-264328 A, there is disclosed a structure in which cooling fans are arranged in parallel to the heater, and air is blown onto the carriage so as to cool the carriage. Further, an air guide is provided on the carriage so as to easily receive the air. Still further, the cooling fans are installed on both ends of the carriage so that the air flows from a center side of the carriage to both the end sides thereof. Yet further, there are disclosed a system in which the carriage is cooled by cooling water and a structure in which a heat-resistant plate for reflecting light is arranged on top of the carriage. In this manner, the temperature of the carriage is prevented from increasing. In such a case, when the cooling water or the heat-resistant plate is used, there is a problem in that an extra space is required and further the cost increases.

Further, the fans are fixed above the carriage so as to face the recording medium. A discharge port for the sucked air is common to a delivery port for the recording medium, and hence there is a fear in that the air is sent to the recording medium immediately before and after the printing so that the recording medium is excessively cooled. There is also a fear in that the temperature of the recording medium is decreased to cause fixing unevenness of the ink landing on the recording medium, or that the air flows around a nozzle surface of the ink jet head to cause ejection failure. The simple generation of air is not fully appropriate.

Solution to Problem

According to one embodiment of the present invention, there is provided an inkjet printer for recording an image on a recording medium by ejecting ink from a recording head while intermittently conveying the recording medium, the inkjet printer including: a recording head for ejecting ink onto a recording medium from a plurality of nozzles; conveyance means for conveying the recording medium; a carriage having the recording head mounted therein, the carriage being reciprocable in a direction intersecting with a conveyance direction of the recording medium; a platen for retaining the recording medium, the platen being arranged so as to be opposed to a surface of the recording head, on which the plurality of nozzles are arranged; a heater provided in the platen, for heating the recording medium; a housing having at least the platen and the carriage built therein; housing-suction means for sucking a gas from an outside into an inside of the housing, the housing-suction means being arranged at a position opposed to a rear surface of the carriage on an upstream side in the conveyance direction; ducts respectively provided on an upper part of the carriage on a forward side in a moving direction thereof and an upper part of the carriage on a rearward side in the moving direction thereof, the ducts being arranged so as to project toward the housing-suction means; carriage-suction means for sucking the gas, which is sucked by the housing-suction means, into the carriage, the carriage-suction means being arranged on a distal end of a projecting part of each of the ducts at a position opposed to the housing-suction means; and an exhaust port having an elongated hole shape, the exhaust port being formed along the moving direction in a lower part of a front surface of the carriage on a downstream side in the conveyance direction. The housing-suction means has a height in a vertical direction, which is larger than a height of the carriage-suction means in the vertical direction. The gas sucked by the housing-suction means is separated into the gas to be caused to flow through an inside of the carriage by the carriage-suction means, and into the gas to be caused to flow through an outside of the carriage. The each of the ducts includes a bending portion for causing the gas, which is sucked by the carriage-suction means, to flow in an inward direct ion of the carriage. The gas flowing through the inside of the carriage cools the inside of the carriage. The gas flowing through the inside of the carriage is discharged from the exhaust port. The discharged gas is discharged to an outside of the housing while being mixed with the gas flowing through the outside of the carriage.

Advantageous Effects of Invention

The outside air taken in by the device directly flows into the carriage. Thus, the temperature inside the carriage is prevented from increasing, and the outside air not taken in by the carriage cools the entire device. The exhaust fan discharges the gas inside the device to the outside, and hence the recording medium is not cooled in a concentrated manner. Thus, the temperature of the ink immediately after the landing can be prevented from decreasing, and further the drying of the ink after the landing can be promoted. In addition, the air less flows around the nozzle surface of the head, thereby preventing various problems with the head, such as reduction of ink landing accuracy, increase of ink mist, and drying of the nozzles.

DESCRIPTION OF EMBODIMENT

An embodiment of the present invention is described with reference to the drawings.

Figure 1:
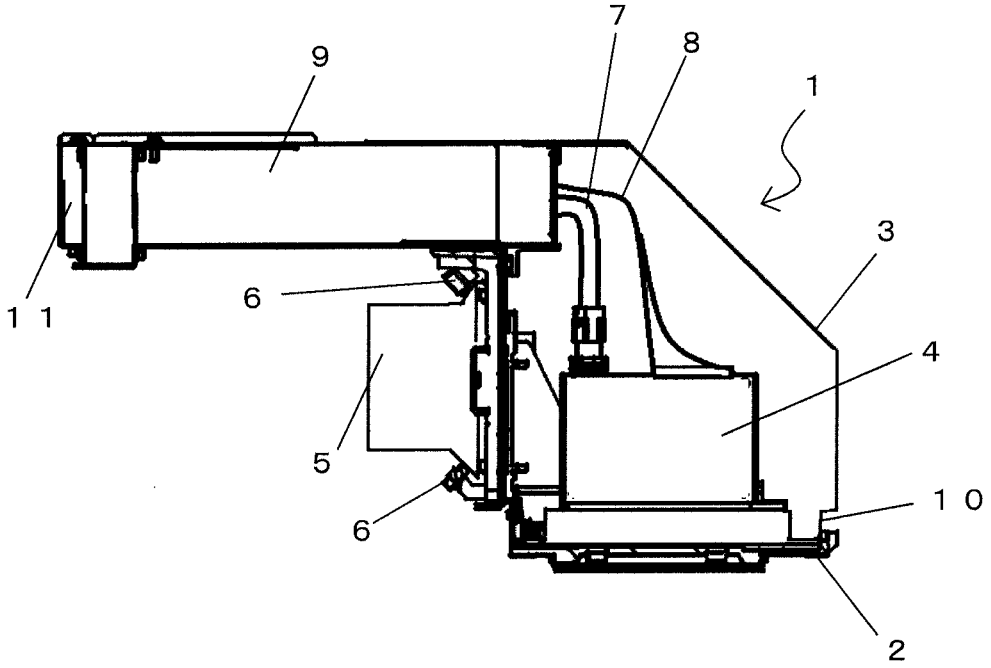
FIG. 1 is a sectional view of a carriage.

FIG. 1 is a sectional view of a carriage. A carriage 1 includes a carriage base 2 and a carriage cover 3 covering the carriage base 2. The carriage base 2 has an L-shape as viewed from a lateral side. On the carriage base 2, recording heads 4 are fixed on a horizontal part thereof, and rollers 6 are arranged on an erecting part thereof so as to sandwich a Y rail 5 from top to bottom. The recording head 4 is, for example, an ink jet head and includes a large number of nozzles on a nozzle surface thereof so as to eject ink. The carriage base 2 has opening portions so as to respectively correspond to the nozzle surfaces of the recording heads 4. The nozzle surfaces of the recording heads 4 are opposed to a recording medium across the respective opening portions. The plurality of nozzles are formed on the nozzle surface of the recording head 4, and ink is ejected from the plurality of nozzles. The carriage 1 is reciprocable along the Y rail 5. A flat cable 8 and an ink tube 7 are connected to an upper part of the recording head 4. A control circuit provided outside the carriage 1 and the recording head 4 are connected through the flat cable 8, and thus communication of an electric signal is performed. Ink is supplied to the recording head 4 through the ink tube 7. The carriage cover 3 is provided so as to cover the recording heads 4, and an exhaust port 10 is formed in a lower part of the carriage cover 3, which is a boundary part between the carriage cover 3 and the carriage base 2.

Ducts 9 are formed on an upper part of the carriage cover 3. The ducts 9 are respectively formed on both ends of the carriage 1. Carriage-suction fans 11 serving as carriage-suction means for sucking a gas into the carriage 1 are each provided at a distal end of the duct 9. A gas is sucked by the carriage-suction fan 11. The gas passes through the duct 9 and further through an space inside the carriage 1 covered by the carriage base 2 and the carriage cover 3 so as to be discharged from the exhaust port 10 to an outside of the carriage 1, that is, an inside of a housing 12. The exhaust port 10 is formed so as to face a cover described later, and the discharged gas flows toward the cover. This flow of the gas inside the carriage 1 cools an inside of the carriage 1 including the recording heads 4.

The flat cable 8 and the ink tube 7 are arranged so as to be routed through the vicinity of a central part of an exhaust port of the duct 9 in a height direction. A flow of the gas from the exhaust port of the duct 9 is separated into an upper side and a lower side by the flat cable 8 and the ink tube 7. With this, air-flows that respectively flow through an upper part and a lower part are generated. That is, the air-flow is separated into two parts so that the inside of the carriage 1 is effectively cooled. For example, the gas that has become warmer after cooling the recording head 3 is difficult to flow toward the upper part of the carriage 1.

Figure 2:
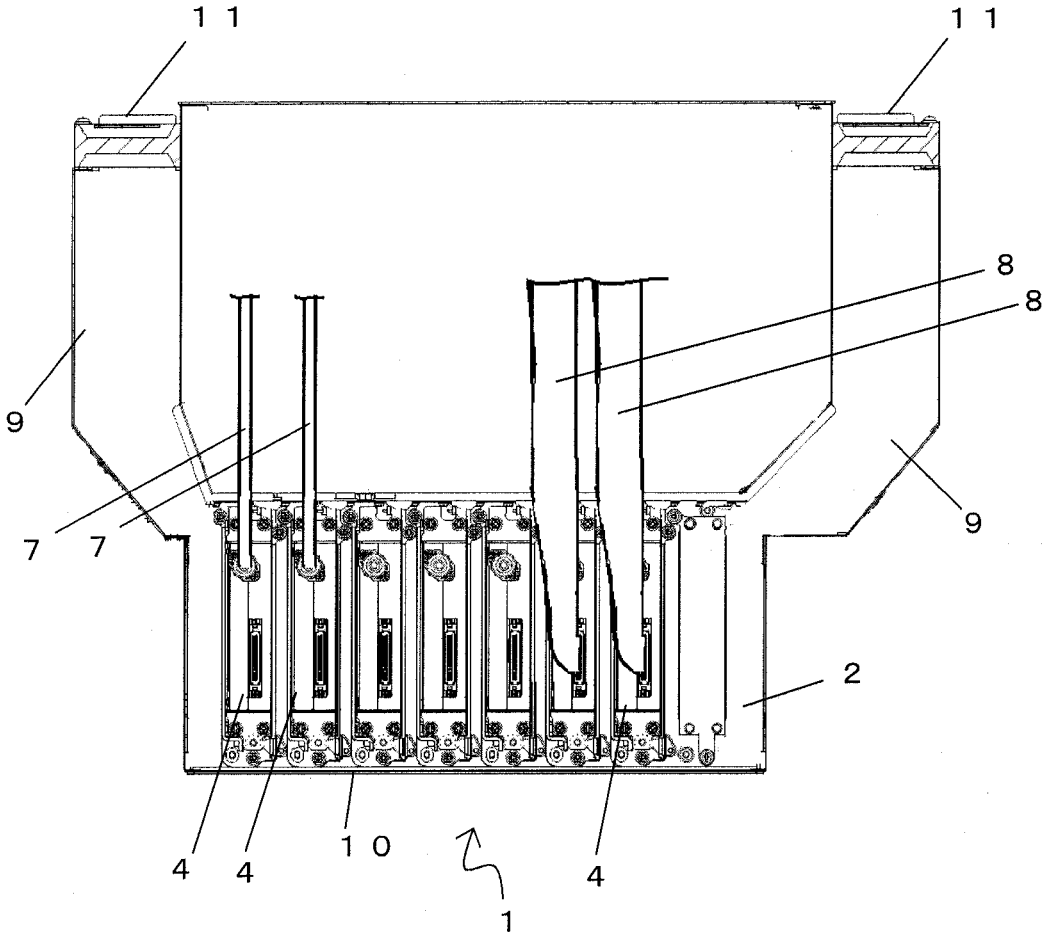
FIG. 2 is an explanatory top view of an internal part of the carriage.

FIG. 2 is an explanatory top view of an internal part of the carriage. The duct 9 has the carriage-suction fan 11 on one end thereof. The duct 9 has a bending portion on another end thereof. The bending portion bends toward the inner side of the carriage 1. Further, a passage of the duct 9 is narrowed toward a distal end of the bending portion in order to increase air velocity as well as to change a direction of air to an inward direction of the carriage 1. The seven recording heads 4 are fixed on the carriage base 2. An empty space for one recording head 4 is secured on an end of the carriage base 2 on the right side of the drawing sheet. The eighth recording head 4 may be fixed in that space. An opening portion in the empty space is covered by a plate so as to prevent an air-flow from flowing downward through the opening portion. The seven recording heads 4 eject colors different from each other. The exhaust port 10 is formed along a side of a front surface of the carriage 1 on a downstream side in a conveyance direction of the recording medium substantially over a range of a width in which the recording heads 4 are arranged. The exhaust port 10 has an elongated hole shape. Air is exhausted from the wide range, and hence air does not gather in one spot. Therefore, the air is suitably exhausted without significant turbulence. A width direction of the flat cable 8 coincides with a longitudinal direction of the recording head 4 in a connecting part between the flat cable 8 and the recording head 4, but the flat cable 8 is arranged while being twisted at the middle. The flat cable 8 is twisted so that the width direction coincides with a moving direction of the carriage 1. That is, the flat cable 8 is arranged so as to separate the direction of the air into two parts by its flat surface. The ink tube 7 is arranged below the flat cable 8 into a bending shape. In the illustration of FIG. 2, the flat cables 8 are only connected to two recording heads 4 on the right side, but in an actual case, the flat cables 8 are connected to all the recording heads similarly. Further, in the illustration of FIG. 2, the ink tubes 7 are only connected to two recording heads 2 on the left side, but in an actual case, the ink tubes 7 are connected to all the recording heads 7 similarly. For the sake of easy understanding, the illustration thereof is omitted herein.

Figure 3:
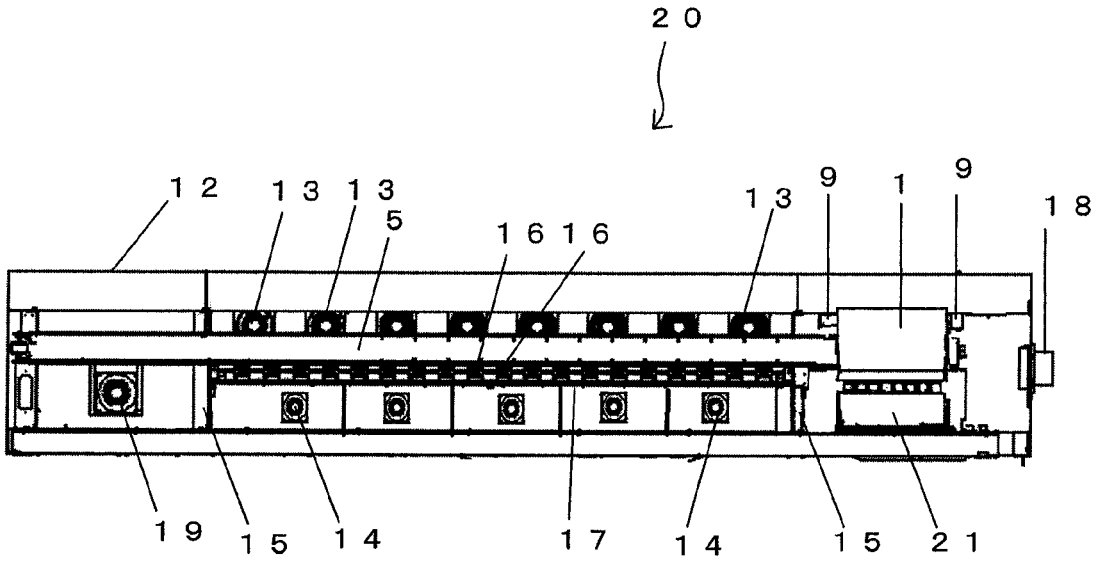
FIG. 3 is an explanatory view of arrangement of suction means and exhaust means in an inkjet printer.

FIG. 3 is an explanatory view of arrangement of suction means and exhaust means in an inkjet printer. A large number of housing-suction fans 13 serving as housing-suction means for sucking a gas are provided in a rear surface of the housing 12 of an inkjet printer 20. The housing-suction fans 13 are arranged along a longitudinal direction of the housing 12. The housing-suction fans 13 are arranged at a height to be opposed to the carriage-suction fans 11. This is because a large amount of air outside the housing 12 can be sucked into the carriage 1.

The Y rail 5 and a platen 17 are also arranged along the longitudinal direction of the housing. The platen 17 is a flat platen, and a large number of through holes are formed therein. Below the platen 17, there is secured a space partitioned by the platen 17, erecting plates 15 provided below both ends of the platen 17, and the like. A gas in the space is discharged to the outside through suction fans 14 so as to generate negative pressure, and the recording medium conveyed on the platen 17 is sucked so as to be fixed. The gas is exhausted by the suction fans 14 from a part below a front paper guide described later.

A large number of conveyance rollers 16 for conveying the recording medium are provided on an upstream side of the platen 17 along the conveyance direction of the recording medium. The conveyance rollers 16 are arranged along a longitudinal direction of the platen 17 at equal intervals. A maintenance unit 21 for the recording heads 4 is provided on one end of the housing 12. The maintenance unit 21 includes a wiper for wiping the nozzle surface of the recording head 4, and a cap for sucking ink while being held in close contact with the nozzle surface. A housing side surface-exhaust fan 18 is provided on aside surface of the housing 12 on the maintenance unit 21 side so as to exhaust the gas inside the housing 12 to the outside. Further, a space for turning when the carriage 1 reciprocates is secured on a side of the housing 12, which is opposite to the housing side surface-exhaust fan 18 across the platen 17. A housing rear surface-exhaust fan 19 is provided on the rear of the space, that is, the rear surface of the housing 12 so as to exhaust the gas inside the housing 12 to the outside.

The maintenance unit 21 is provided on the housing side surface-exhaust fan 18 side, and hence the volume of a space in the housing 12 on the housing side surface-exhaust fan 18 side is smaller than the volume of the space in the housing 12 on the housing rear surface-exhaust fan 19 side. Therefore, the fans for exhausting the gas are respectively provided on the side surface on the side having the smaller volume and on the rear surface on the side having the larger volume. The flow degree of the gas is equalized as much as possible so that a difference in air resistance in the moving direction when the carriage 1 is moved is reduced.

Figure 4:
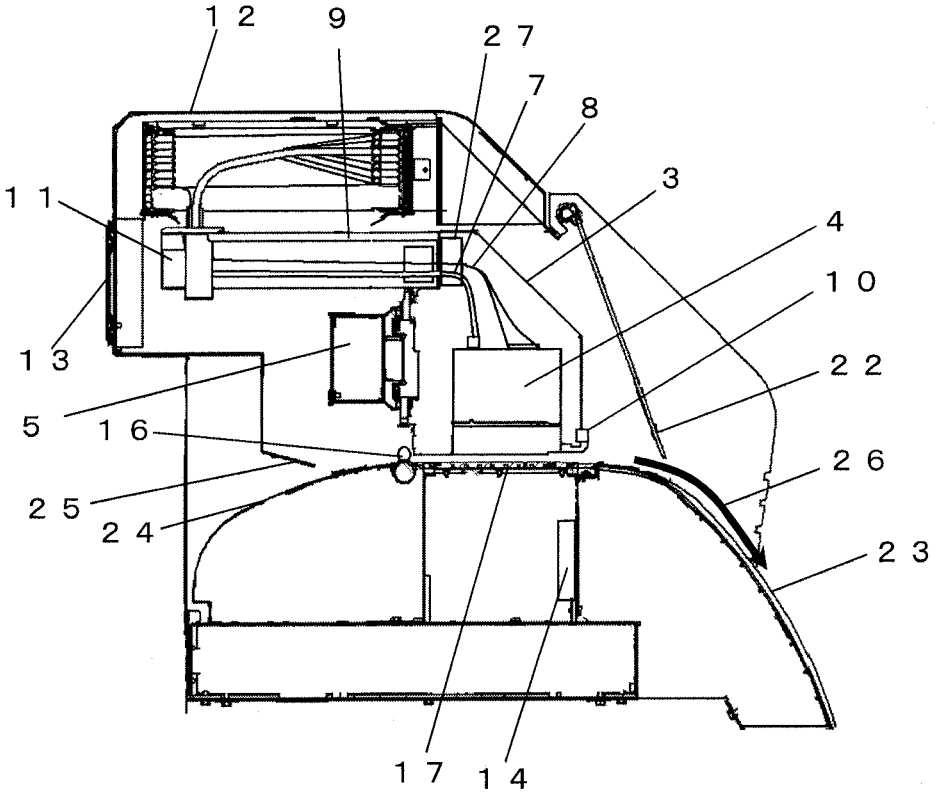
FIG. 4 is a sectional view of the inkjet printer.

FIG. 4 is a sectional view of the inkjet printer. The housing-suction fan 13 has a height larger than that of the carriage-suction fan 11, which is twice as large as that of the carriage-suction fan 11. As the housing-suction fan 13, a large-sized fan is used so as to suck a large amount of the outside air. The gas sucked into the housing 12 includes a gas to be sucked into the carriage 1 by the carriage-suction fans 11 and a gas to pass through the outside of the carriage 1. The sucked air is caused to flow toward a cover 22 arranged on a front surface of the housing 12. The carriage-suction fans 11 are provided so as not to close the housing-suction fans 13, and hence abrupt change of a direction of air-flow is reduced. The cover 22 is connected to the housing 12 so as to be pivotable. Opening portions 27 of the respective ducts 9 on an inner side of the carriage 1 are arranged so as to be oriented inward to face each other. A gas flows inward, and further, the flow thereof is separated into an upper side and a lower side by the flat cables 8. The flow of the gas is separated into the upper side and the lower side also by the ink tubes 7. The flat cables 8 function more dominantly than the ink tubes 7 to separate the air-flow into the upper side and the lower side.

A front paper guide 23 is provided on a downstream side of the platen 17 in the conveyance direction of the recording medium, and a rear paper guide 24 is provided on an upstream side thereof. The conveyance rollers 16 are arranged in a portion between the rear paper guide 24 and the platen 17. The recording medium is heated in the rear paper guide 24, and conveyed while being nipped by the conveyance rollers 16. Then, the recording medium is sent to the platen 17, and further delivered along the front paper guide 23. A heater is also provided in each of the platen 17 and the front paper guide 23 so as to heat the recording medium. In this manner, drying of ink adhered to the recording medium is promoted.

The rear paper guide 24 is opposed to a bending portion 25, which is arranged above the rear paper guide 24 and corresponds to a portion at which an end portion of the housing 12 is bent. The bending portion 25 is bent toward an inward direction of the housing 12, and further approaches the rear paper guide 24 toward a distal end thereof. Further, the distal end portion of the bending portion 25 is arranged so as to be lower than a flat portion on a surface of the platen 17 in a vertical direction. With this, the gas sucked by the housing-suction fans 13 easily flows, even in a small amount, toward the downstream side in the conveyance direction of the recording medium, that is, toward the recording head 3 or the cover 22. In other words, the sucked air is difficult to flow out from the bending portion 25.

The front paper guide 23 is opposed to a distal end of the cover 22 provided above the front paper guide 23. Further, the cover 22 approaches the front paper guide 23 toward a distal end thereof. The front paper guide 23 has a curved surface curved downward toward the downstream side in the conveyance direction of the recording medium. With the cover 22 and the front paper guide 23 configured as described above, the gas inside the housing 12 easily flows along a surface of the front paper guide 23. The heater is provided inside the front paper guide 23, and the recording medium is heated by the heater, to thereby promote the drying of the ink adhered to the recording medium. In this case, when a solvent that evaporates in the vicinity of a surface of the recording medium stagnates, the drying of the ink is inhibited. Therefore, the stagnation of the solvent is prevented by sending air. The cover 22 is arranged closer to the front paper guide 23 so as to form an air-flow along the front paper guide 23 in a direction indicated by the arrow 26, and is arranged so as to be oriented downward.

Further, the gas discharged from the exhaust port 10 is directed to the cover 22. The gas blown onto the cover 22 forms an air-flow along the cover 22 in a downward direction, and further flows along the front paper guide 23. The gas exhausted from the exhaust port 10 is discharged to the outside while being mixed with a gas flowing through the outside of the carriage 1. The gas sucked by the carriage-suction fans 11 flows faster than the gas flowing through the outside of the carriage 1 when discharged from the discharge port 10. Along with the air-flow from the discharge port 10, a gas surrounding the air-flow also flows faster, and hence the gas can be smoothly discharged from a portion between the front paper guide 23 and the cover 22 to the outside. It is possible to promote the discharge of the solvent having evaporated into the gas from the ink stagnating in the housing, and hence the ink can be dried in a shorter period of time.

Further, the gas sucked into the housing 12 is discharged from the housing side surface-exhaust fan 18, the housing rear surface-exhaust fan 19, a portion between the rear paper guide 21 and the bending portion 25, or a portion between the front paper guide 23 and the cover 22, or through the suction by the platen 17.

Figure 5:
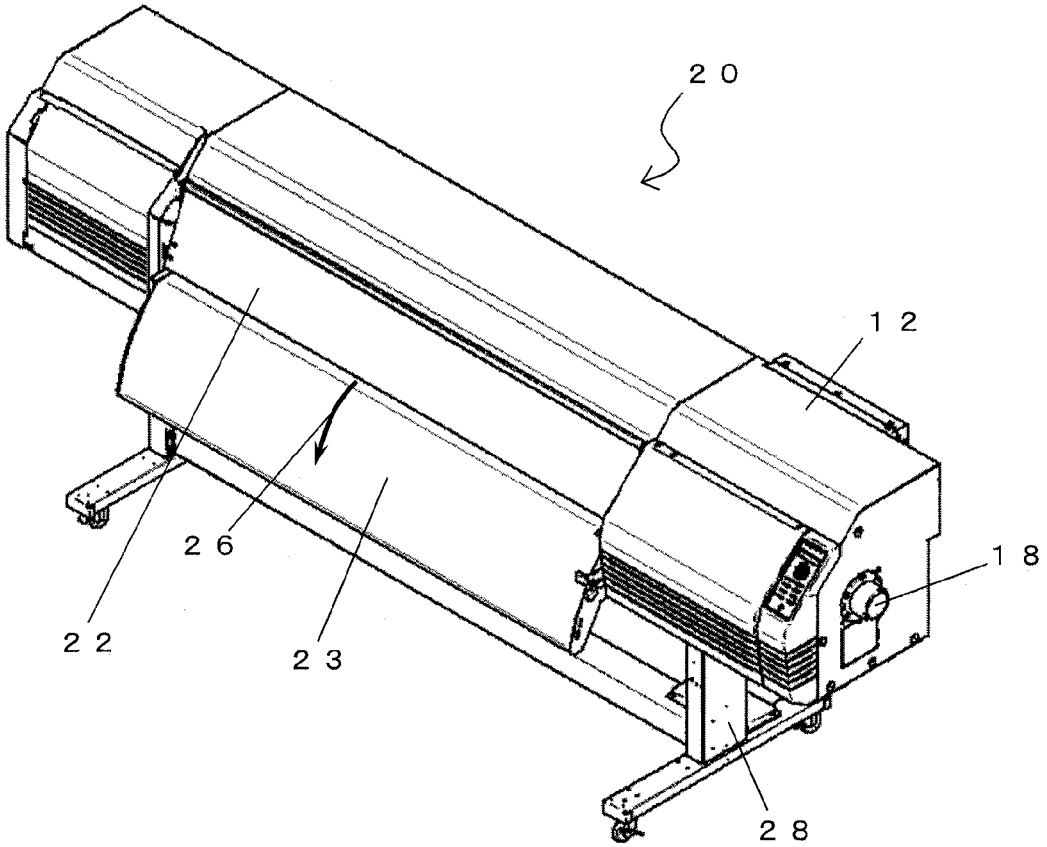
FIG. 5 is an external view of the inkjet printer.

FIG. 5 is an external view of the inkjet printer. In the inkjet printer 20, the housing 12 is supported by legs 28. The legs 28 are fixed to ends of a lower surface of the housing 12.

INDUSTRIAL APPLICABILITY

The present invention is applicable to an inkjet printer, and particularly applicable to a large-sized inkjet printer.

REFERENCE SIGNS LIST

1 carriage
2 carriage base
3 carriage cover
4 recording head
5 Y rail
6 roller
7 ink tube
8 flat cable
9 duct
10 exhaust port
11 carriage-suction fan
12 housing
13 housing-suction fan
14 suction fan
15 erecting plate
16 conveyance roller
17 platen
18 housing side surface-exhaust fan
19 housing rear surface-exhaust fan
20 inkjet printer
21 maintenance unit
22 cover
23 front paper guide
24 rear paper guide
25 bending portion

The invention claimed is:

1. An inkjet printer for recording an image on a recording medium by ejecting ink from a recording head while intermittently conveying the recording medium, the inkjet printer comprising:

a recording head for ejecting ink onto a recording medium from a plurality of nozzles;

conveyance means for conveying the recording medium;

a carriage having the recording head mounted therein, the carriage being reciprocable in a direction intersecting with a conveyance direction of the recording medium;

a platen for retaining the recording medium, the platen being arranged so as to be opposed to a surface of the recording head, on which the plurality of nozzles are arranged;

a heater provided in the platen, for heating the recording medium;

a housing having at least the platen and the carriage built therein;

housing-suction means for sucking a gas from an outside into an inside of the housing, the housing-suction means being arranged at a position opposed to a rear surface of the carriage on an upstream side in the conveyance direction;

ducts respectively provided on an upper part of the carriage on a forward side in a moving direction thereof and an upper part of the carriage on a rearward side in the moving direction thereof, the ducts being arranged so as to project toward the housing-suction means;

carriage-suction means for sucking the gas, which is sucked by the housing-suction means, into the carriage, the carriage-suction means being arranged on a distal end of a projecting part of each of the ducts at a position opposed to the housing-suction means; and an exhaust port having an elongated hole shape, the exhaust port being formed along the moving direction in a lower part of a front surface of the carriage on a downstream side in the conveyance direction, wherein the housing-suction means has a height in a vertical direction, which is larger than a height of the carriage-suction means in the vertical direction, wherein the gas sucked by the housing-suction means is separated into the gas to be caused to flow through an inside of the carriage by the carriage-suction means, and into the gas to be caused to flow through an outside of the carriage, wherein the each of the ducts comprises a bending portion for causing the gas, which is sucked by the carriage-suction means, to flow in an inward direction of the carriage, wherein the gas flowing through the inside of the carriage cools the inside of the carriage, wherein the gas flowing through the inside of the carriage is discharged from the exhaust port, and wherein the discharged gas is discharged to an outside of the housing while being mixed with the gas flowing through the outside of the carriage.

2. An inkjet printer according to claim 1, further comprising:

a front paper guide for guiding the recording medium to a downstream side of the platen in the conveyance direction, and heating the recording medium; and a cover arranged at a distance from the front paper guide so that a distal end thereof is positioned on a lower side in the vertical direction with respect to the surface of the recording head, on which the plurality of nozzles are arranged, the cover being connected to the housing so as to be pivotable, wherein a part of the gas, which is sucked by the housing-suction means, is discharged from a portion between the front paper guide and the cover, wherein the discharge port is formed so as to face the cover, wherein the cover is arranged so as to approach the front paper guide toward the distal end in order that the gas is discharged from the discharge port in a direction along the front paper guide, and wherein the front paper guide is curved in the vertical direction.

3. An inkjet printer according to claim 1, wherein the recording head comprises, on an upper part thereof:

an ink connector to which a tube for supplying the ink is connected; and an electric connector to which a flat cable for transmitting an electric signal is connected, wherein the tube connects an ink tank arranged in the housing and the ink connector to each other, wherein the flat cable connects a circuit board arranged in the housing and the electric connector to each other, wherein the tube and the flat cable are arranged so as to pass through an opening portion of the each of the ducts inside the carriage, and wherein a flow of the gas discharged from the opening portion is caused to separately flow, by the tube and the flat cable, into an upper side and a lower side with respect to the tube and the flat cable.

4. An inkjet printer according to claim 1, further comprising:

first exhaust means for exhausting the gas inside the housing to the outside, the first exhaust means being arranged on the rear surface side of the housing, on which the housing-suction means is provided; and second exhaust means for exhausting the gas inside the housing to the outside, the second exhaust means being arranged on one of side surface sides of the housing in a longitudinal direction thereof, wherein the inkjet printer exhausts the gas inside the housing in at least three directions.

* * * * *